US005740624A

United States Patent [19]

Baseley

[11] Patent Number: 5,740,624

[45] Date of Patent: Apr. 21, 1998

[54] IDENTIFICATION CARD HOLDER

[76] Inventor: Paul Reginald Baseley, 2 & 3 Park Barn Cottages, Ditcham Park, Near Petersfield, Hampshire GU31 5RL, England

[21] Appl. No.: 399,213

[22] Filed: Mar. 6, 1995

[51] Int. Cl.[6] ..... G09F 3/20

[52] U.S. Cl. ..... 40/649; 40/27.5

[58] Field of Search ..... 206/0.84, 0.81, 206/37, 38; 40/27.5, 490, 649, 642

[56] References Cited

U.S. PATENT DOCUMENTS

| | | | |
|---|---|---|---|
| 316,664 | 4/1885 | Scales | 206/0.81 X |
| 758,776 | 5/1904 | Pawl | 206/38 |
| 1,175,652 | 3/1916 | Marquette | 40/649 |
| 1,436,484 | 11/1922 | Dahl | 40/649 |
| 1,974,881 | 9/1934 | Spillane | 40/642 X |
| 2,814,139 | 11/1957 | Clare | 206/0.81 X |
| 2,898,257 | 8/1959 | Carver | 40/649 X |
| 3,623,250 | 11/1971 | Misenko | 40/649 |
| 4,518,080 | 5/1985 | Ohlson | 206/38 X |
| 4,836,365 | 6/1989 | Hall . | |

FOREIGN PATENT DOCUMENTS 0121598 10/1984 European Pat. Off. .

OTHER PUBLICATIONS

Document labeled A1, being a German language leaflet concerning "CardSafes" credit card holders distributed by PS–Neue Produkte für die Werbung GmbH, Heiligenhaus, Germany. The publication date is unknown. A translation is attached.

Copies of the cover page and two inner pages of a document captioned "Werbeartikel Nachrichten," apparently published by Inform Plastik GmbH, Lemgo/Lieme, Germany. The publication bears a date of Jan. 1, 1995, and is labeled A2 for identification.

A document labeled A3, apparently constituting a brochure published by Jurjen de Vries, Leeuwarden, Netherlands, the date of which is unknown. A partial translation is attached.

*Primary Examiner*—Joanne Silbermann
*Attorney, Agent, or Firm*—William R. Hinds

[57] ABSTRACT

An identification card holder for cards of a defined size is provided. The card holder includes a base plate and a front plate secured in spaced apart relationship to define a card receiving slot to receive an inserted card and a mouth opening at the edge of the holder. The front plate includes a face hole of a size less than that of the card. The base plate includes a spring acting to urge an inserted card towards a card-contacting face of the front plate and situated so as not to interfere with a magnetic strip of an inserted card. The card-contacting face of the front plate has a channel of sufficient depth that embossed characters on an inserted card do not contact the surface of the front plate.

13 Claims, 4 Drawing Sheets

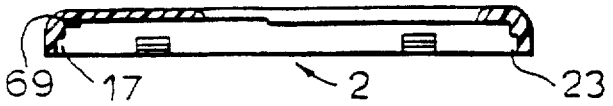
FIG. 4
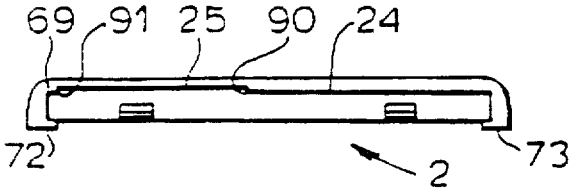
FIG. 5
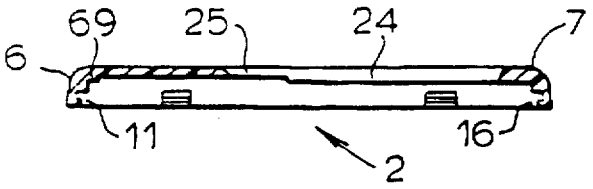
FIG. 3
FIG. 2
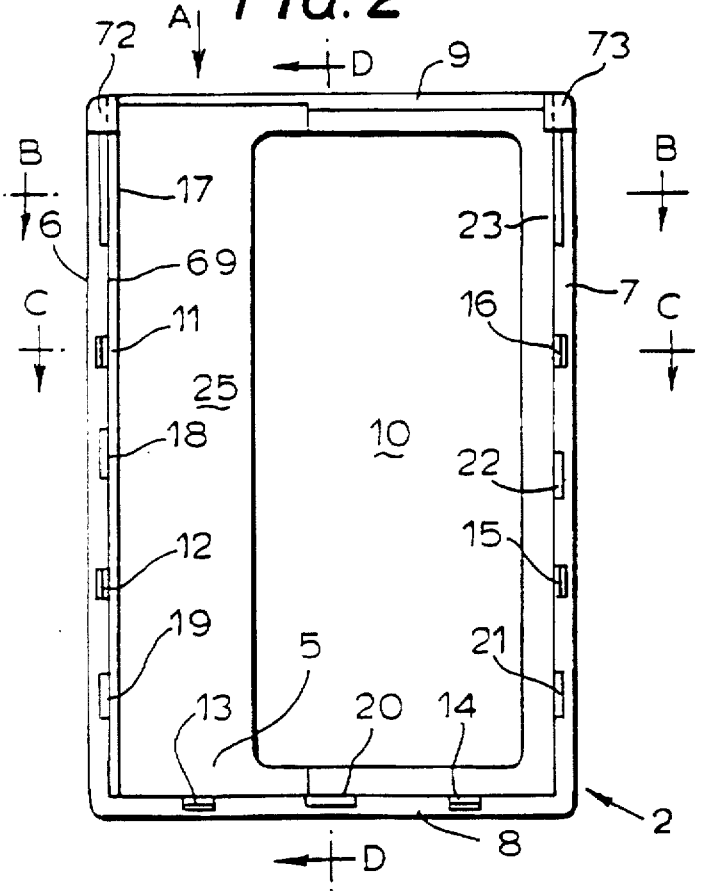
FIG. 6
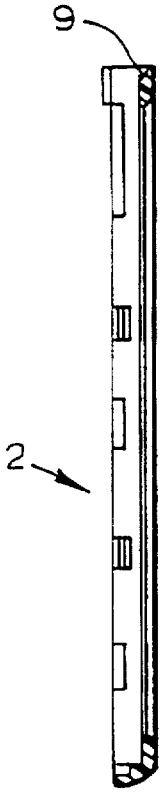

IDENTIFICATION CARD HOLDER

FIELD OF THE INVENTION

Identification cards such as credit cards, cash cards, debit cards, security passes and the like are a part of everyday life. Most such cards incorporate an embossed area giving identifying characters such as the card owner's name, date of expiry of the card, and account or card identification number. Most such cards also incorporate a magnetic strip, on their reverse in the main, for machine reading of the card. Identification cards are so common that international standards exist (such as ISO 7810) standardising such features as the size and location of the magnetic strip, the size, location and depth of embossed characters and the overall size of the card.

RELATED ART

A problem with identification cards is their safe storage. It is frequently the case that the embossed text becomes difficult to read as surface colouration is worn off through abrasion of the card in use. A further problem is damage to the magnetic strip through abrasion. This is particularly a problem for frequently used cards as the usual form of credit card holder is a flexible envelope of plastics or the like having a slightly roughened surface to assist retention of the card and so prevent accidental loss of the card. The roughness of the surface contributes markedly to wear of the embossed lettering and magnetic strip.

A credit card has been proposed (under the mark 'Card Safes' of P. S-Neue Produkt fur die Werbung GmbH) that comprises a flattened sleeve of stiffly flexible plastics material with four longitudinally extending raised strips on each inward facing surface of the flattened sleeve (i.e. 8 strips in total). These strips hold the magnetic stripe of a card free from the adjacent surface of the sleeve. The height of the strips is low (less than 0.3 mm).

Another proposal has been to provide a generally rectangular rigid plastics casing defining a slot having a mouth opening at the edge of the holder and a spring situated within the slot towards the closed end opposite the mouth. A lip at the mouth extends into the slot. The edge of the casing adjacent the mouth is recessed so that in use a card may be inserted into the mouth to bear against the opposing spring. The recess allows pressure to be applied to the card edge to work against the spring so that the card can be moved inwards of the lip. By moving the card transversely of the direction of insertion the card edge can be brought into engagement with an inner edge of the lip and held there by the pressure of the spring. Removal of the card is by displacing the card into the slot (against spring pressure), moving the card transversely away from the lip, and then releasing the pressure of the card against the spring. This holder has the disadvantage that it is thick (over 7 mm) due to the need to move the card transversely for retention, and that the card is not fully protected since the edge of the card is exposed at the recess to allow finger pressure to be applied.

A further type of identification card holder comprises a rectangular rigid plastics casing again defining a slot having a mouth opening at the edge of the holder so that a card may be slid in to the slot. Towards the end of the slot furthest from its mouth the walls of the casing taper so as to provide frictional grip against the card edges. A face hole in the side of the rectangular casing exposes part of the card so that a finger inserted in the face hole can be used to push a card out of the casing. Longitudinal walls to each side of the slot separate the slot into two channels so that two cards may be inserted. This product is sold under the mark β Card. This type of identification card holder does not provide positive protection for embossed areas of cards and is also thick (about 6 mm) in relation to the cards held. In another art (which will be useful for understanding the disclosed embodiment) U.S. Pat. No. 4,836,365 discloses a dispensing holder for coins or similar discs comprising a single middle plate and two face plates which sandwich and are joined to the middle plate, each face plate and the middle plate defining between them disc-receiving slots having mouths open to edges of the middle plate and respective face plate for insertion and removal of discs, each face plate having at each slot a face hole of a size less than the given disc diameter, the middle plate having for each slot a finger spring acting towards the face hole to hold a disc in the slot but allow it to be dispensed by manual depression against the spring and sliding through the slot mouth.

SUMMARY OF THE INVENTION

The applicants have realised that a secure identification card holder may be devised that protects embossed characters on identification cards, is slim, and that protects magnetic strips.

Optionally the credit card holder may also hold coins, tokens or like discs.

The present invention provides an identification card holder for cards of a defined size, the card holder comprising a base plate and front plate secured in spaced apart relationship to define a card receiving slot to receive an inserted card and with a mouth opening at the edge of the holder, the front plate having a face hole of a size less than that of the card, the base plate having a spring acting to urge an inserted card towards a card-contacting face of the front plate and situated so as not to interfere with a magnetic strip of an inserted card, the card-contacting face of the front plate having a channel of a depth sufficient that embossed characters on an inserted card do not contact the surface of the face plate.

BRIEF DESCRIPTION OF THE DRAWINGS

The full scope of the invention will become apparent from the appended claims and the following non-limitative description of one embodiment of identification card holder in accordance with the invention with reference to the drawings in which:

FIG. 2. is an underside plan view of part of a holder in accordance with the invention.

FIG. 3. is a section on the line 3—3 of FIG. 2.

FIG. 4 is a section on the line 4—4 of FIG. 2.

FIG. 5 is an end view in the direction A of FIG. 2.

FIG. 6 is a sectional view along line 6—6 of FIG. 2.

DESCRIPTION OF THE PREFERRED EMBODIMENT

Figure 1:
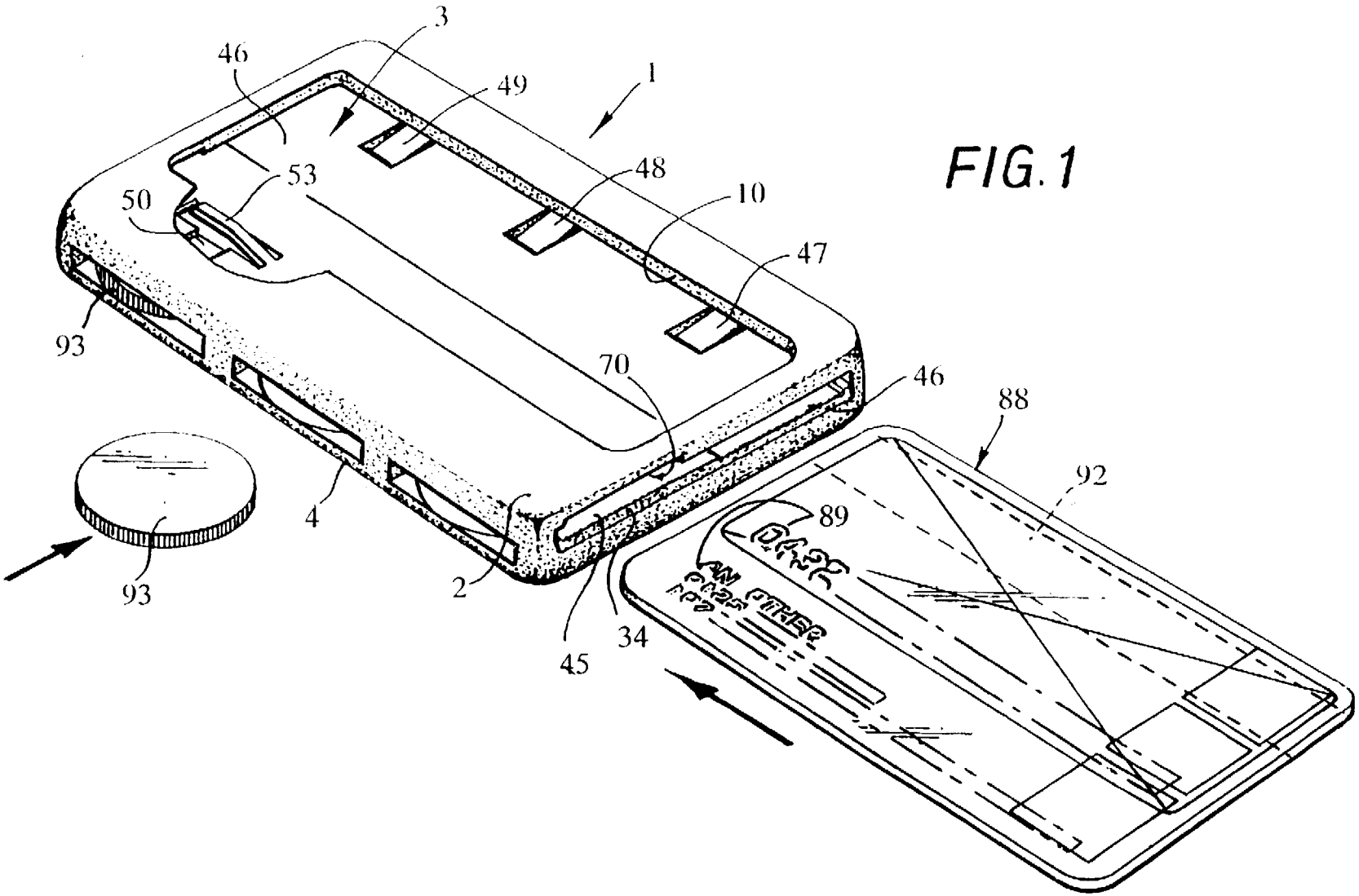
FIG. 1. is a cut-away perspective view of a coin holder in accordance with the invention.
Figure 7:
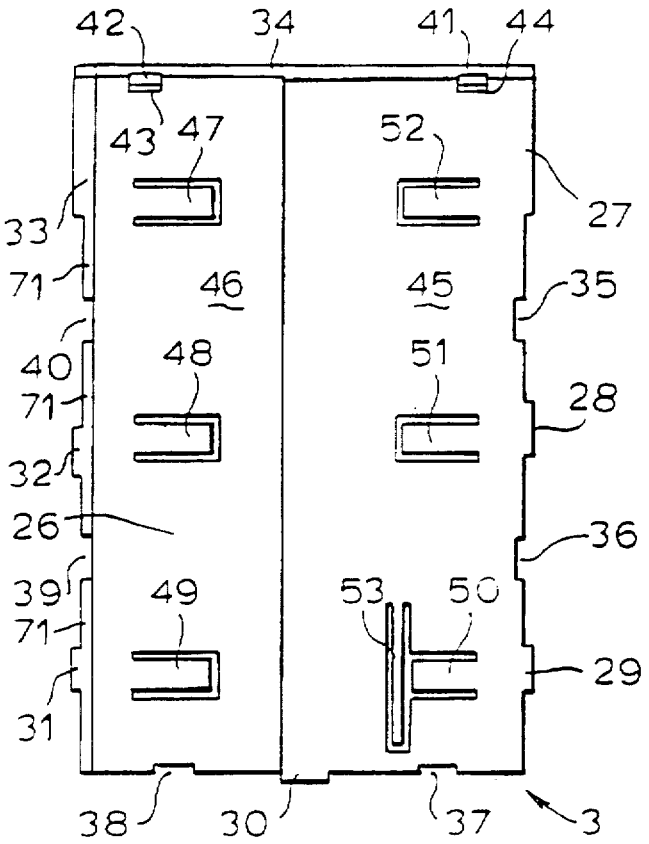
FIG. 7 is a plan view of a middle part of the coin holder of FIG. 1.
Figure 8:
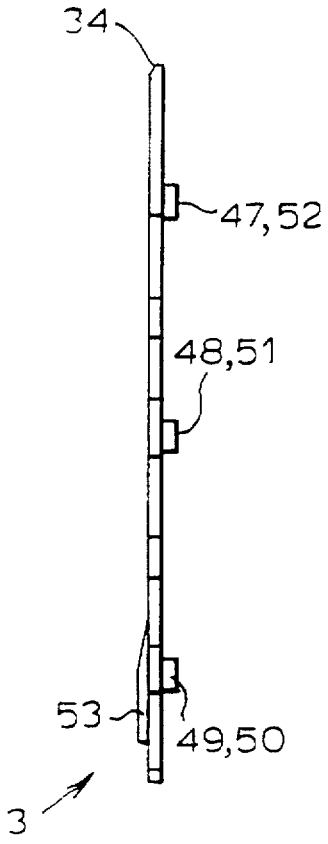
FIG. 8 is a side view of the middle part shown in FIG. 7.
Figure 9:
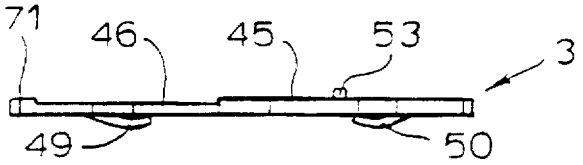
FIG. 9 is an end view of the middle part shown in FIG. 7.
Figure 13:
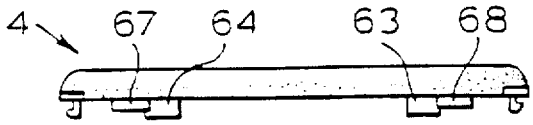
FIG. 13 is an end view of the base part of FIG. 10.
Figure 12:
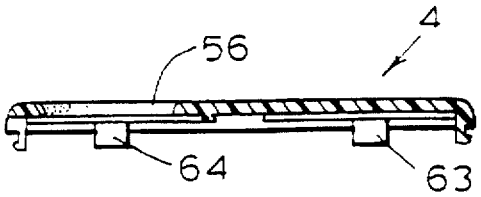
FIG. 12 is a split-sectional view of the middle part shown in FIG. 10 along the lines 12—12.
Figure 11:
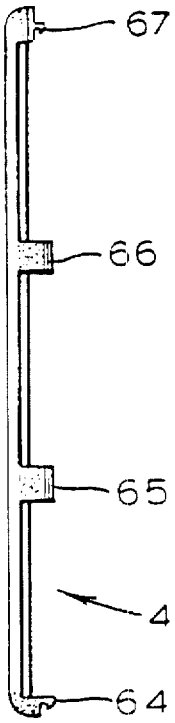
FIG. 11 is a side view of the holder of FIG. 1.
Figure 10:
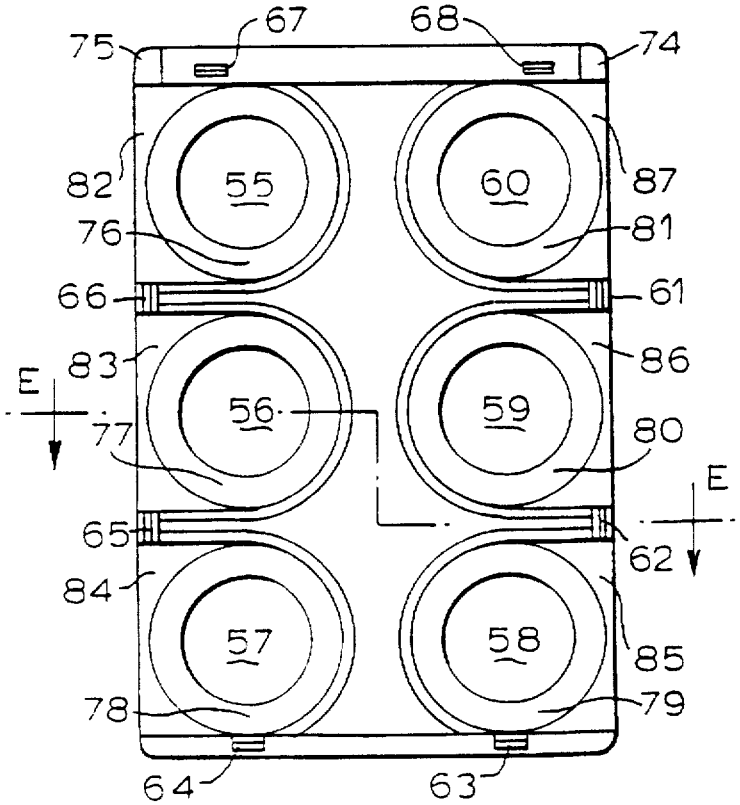
FIG. 10 is a plan view of a base part of the card holder of FIG. 1.

FIG. 1 shows an overall view of a combined identification card and token/coin holder 1 comprising a front plate 2, a middle plate 3, and a back plate 4. The front plate, middle plate and back plate are all formed of an Acetal plastics material (Delrin—a trade mark of DuPont) and snap into engagement to form the combined identification card and token/coin holder 1 in a manner described with reference to FIGS. 2–12 of the accompanying drawings.

Other materials may of course be use for the holder provided they have sufficient rigidity. For snap-action inter-engagement some resilient deformability of the material is required.

Front plate 2 comprises a generally rectangular plate 5 having side walls 6 and 7 along the long sides of the rectangular plate 5 and an end wall 8 against one of the short sides of rectangular plate 5. The remaining short side of the rectangular plate 5 has a chamfered edge 9 (sloping at 30°) for reasons that will become apparent later. Rectangular plate 5, side walls 6 and 7 and end wall 8 thus form an open sided tray.

The rectangular plate 5 has a generally rectangular window 10.

Side walls 6 and 7 and end wall 8 have ridged recesses 11, 12, 13, 14, 15 and 16 and plain recesses 17,18,19,20,21,22, 23, the purpose of which will become apparent below.

Lands 72 and 73 stand on side walls 6 and 7 towards the chamfered edge 9 of rectangular plate 5 and overly parts of plain recesses 17, 23.

The structure of the ridged recesses 11,12,13,14,15,16 is shown as indicated in FIG. 3 and the structure of the plain recesses 17,18,19,20,21,22,23 is shown as indicated in FIG. 4.

The generally rectangular plate 5 is of different thicknesses across its width having thicker parts 24, 69 and a thinner part 25 forming a channel in generally rectangular plate 5, the difference in thickness between these parts defining steps 90 and 91.

Middle plate 3 is a generally rectangular plate 26 having a chamfered edge 34 corresponding with chamfered edge 9 of the rectangular plate 5. Middle plate 3 also has lateral protrusions 27,28,29,30,31,32 and 33 corresponding to plain recesses 17,18,19,20,21,22 and 23 respectively. Chamfered edge 34 may be inserted into plain recesses 17, 23, to underly lands 72 and 73 and by slight distortion of lands 72, 73 and the middle plate 3, the lateral protrusions 27,28,29, 30,31,32, and 33 can be forced to engage with plain recesses 17,18,19,20,21,22, and 23 so relieving the distortion. Rectangular plate 5 and middle plate 3 thereby form an identification card receiving slot 70 closed at three sides by side walls 6,7 and end wall 8 and open at the remaining side to receive identification cards.

Chamfered edges 9 and 34 mean that the mouth of the identification card receiving slot 70 is flared so as to facilitate insertion of identification cards 88.

Middle plate 3 also has indentations 35,36,37,38,39 and 40 corresponding with ridged recesses 11,12,13,14,15 and 16 respectively of the side walls 6, 7, and end wall 8. Middle plate 3 also has apertures 41, 42 which have lips 43, 44 the purpose of which is discussed below.

Rectangular plate 26 has thicker parts 45, 71 and a thinner part 46 forming a channel in the face of rectangular plate 26, the function of which will be discussed below. Middle plate 3 has formed in it integral finger springs 47,48,49,50,51,52 which in use extend away from the identification card receiving slot 70 and a further finger spring 53 which in use extends towards the identification card receiving slot 70.

Back plate 4 comprises a generally rectangular body 54 having 6 circular apertures 55,56,57,58,59,60. Ridged fingers 61,62,63,64,65 and 66 stand up from rectangular body 54 and correspond in position to the indentations 35,36,37, 38,39 and 40 of middle plate 3 and the ridged recesses 11,12 13,14,15 and 16 of front plate 2. Shorter ridged fingers 67 and 68 correspond in position to apertures 41, 42 of middle plate 3. Land receiving surfaces 74, 75 are situated at adjacent corners of rectangular plate 54 to correspond with lands 72, 73 of front plate 2. Circular apertures 55,56,57, 58,59,60 have at their margins annular indented areas 76,77, 78,79,80,81 which form, towards the sides adjacent the long side of the rectangular plate 54, shallow lips 82,83,84,85, 86,87 the purpose of which will become evident below.

Engaged front plate 2 and middle plate 3, may be inter-engaged with back plate 4 by pressing them together so that ridged fingers 61,62,63,64,65,66 pass through indentations 35,36,37,38,39 and 40 to snap into engagement with ridged recesses 11,12,13,14,15 and 16. Shorter fingers 67 and 68 will snap into engagement with lips 43, 44 of apertures 41,42. Lands 72, 73 meet land receiving surfaces 74, 75. The assembled identification card holder 1 is shown in FIG. 1.

When engaged to form the identification card and token/coin holder 1, identification cards 88 may be inserted into the identification card receiving slot 70 in such a manner that embossed areas 89 of the card lie adjacent to thinner part 25 of the front plate. Finger spring 53 lies behind the thinner part 25 of rectangular plate 5 and is concealed from view (shown under cut-away part of FIG. 1). Finger spring 53 therefore acts against the reverse side of the embossed areas 89 but these are prevented from contacting the thinner part 25 by contact of the card 88 with thicker parts 24 and 69. The depth of the steps 90 and 91 is such as to ensure clearance. ISO 7810 defines a maximum thickness of the embossed part of an identification card as 0.51 mm but in practice the normal range of heights of embossed areas is in the range 0.4 mm to 0.425 mm so that in normal circumstances a step of 0.45 mm would be sufficient to clear this.

The window 10 is of a size such that most of the face of the card is visible through it. Some of the embossed area 89 may be visible but for the majority of cards sensitive information (such as name and expiry date) will be concealed by thinner part 25. Usually, for a credit card or the like, the card or account number will be visible through window 10 so that it may be read without removing the card.

As is evident from the above description middle plate 3 has thicker and thinner parts 45 and 46 such that two credit cards may be inserted back-to-back with the magnetic strip 92 of one card lying against the reverse side of the embossed area of the other card. By this means two cards can comfortably be received in the holder. Whether receiving one card or two cards the embossed area 89 is protected by the appropriate channel (in face plate 2 or middle plate 3) and the magnetic strip 92 is protected either by bearing against the other card if present or if no card is present by being held clear of the middle plate by the spring pressure of finger spring 53.

It will be seen that the identification card holder described completely encases the edges of a card in a rigid casing so protecting them against damage.

Turning now to the reverse side of the identification card holder it can be seen that back plate 4 in combination with middle plate 3 provides a coin holder which functions in a manner similar to that of U.S. Pat. No. 4,836,365 and lips 82, 83, 84, 85, 86 and 87 serve to retain coins 93 in the holder through pressure of finger springs 47, 48, 49, 50, 51 and 52 such that coins or tokens 93 can only be removed by finger pressure through apertures 55, 56, 57, 58, 59 and 60.

The above described embodiment shows a combined identification card and token/coin holder. Such an identification card/coin holder is of particular interest where transit systems are moving from token to identification card based travel. Token based systems include the Transit Systems of Miami, Los Angeles, New York and Chicago. Token based toll systems include the New Jersey Parkway. The identification card/coin holder described will hold tokens from these systems (for Chicago, half-fare tokens) and will also hold quarter dollars.

The overall dimensions of the coin holder 1 described are length 89 mm, width 59.5 mm and thickness 8.5 mm and will accept two identification cards (ISO 7810 dimensions, width 85.6 mm, height 53.98 mm, thickness 0.76 mm and maximum embossed height 0.51 mm) and 6 quarter dollars (thickness of 1.76 mm and diameter of 24.15 mm). The coin holder thus provides an extremely compact and secure means for storage of identification cards and tokens and provides the possibility of an even slimmer holder for identification cards alone. It will be clear to the person skilled in the art that an identification card holder may be proved that does not have a coin holder included. It will be equally clear to the person skilled in the art that a pair of identification card holders could be provided back-to-back (e.g. if finger spring 50 were replaced by a finger spring of the nature of finger spring 53) thereby allowing up to four cards to be held.

The present invention provides the advantage that embossed areas and magnetic stripes of cards are protected.

I claim:

1. An identification card holder holding a removably inserted identification card bearing a magnetic strip on one face and embossed characters on the other face, the card holder comprising a base plate and front plate secured in spaced apart relationship to define a card receiving slot to receive the inserted card and with a mouth opening at the edge of the holder, the front plate having a face hole of a size less than that of the card, the base plate having a spring acting to urge the inserted card towards a card-contacting face of the front plate and situated so as not to interfere with the magnetic strip of the inserted card, the card-contacting face of the front plate having a channel in the area of the embossed characters, of a depth sufficient that the embossed characters on the inserted card do not contact the surface of the front plate.

2. An identification card holder as claimed in claim 1 in which the base plate comprises a middle plate and a back plate, the middle plate bearing the spring and the back plate being secured to the front plate to retain the middle plate.

3. An identification card holder as claimed in claim 2 in which the back plate and front plate are secured by snap action inter-engagement of fingers and recesses disposed on said back plate and front plate.

4. An identification card holder as claimed in claim 3 in which the middle plate has a channel of a depth sufficient that a pair of said cards are held back to back in the holder, the embossed characters of the pair of cards contacting neither the front plate nor the middle plate.

5. An identification card holder as claimed in claim 4 in which the spring is integral with and formed from the material of the middle plate.

6. An identification card holder as claimed in claim 4 in which the middle plate and the back plate define therebetween a holder for coins or like discs.

7. An identification card holder as claimed in claim 6 in which the middle plate comprises integral finger springs extending respectively towards the front plate to secure identification cards or towards the base plate to secure coins or tokens.

8. An identification card holder as claimed in claim 7 in which the back plate and middle plate are engaged by snap action inter-engagement of fingers and recesses disposed on said back plate and front plate.

9. An identification card holder as claimed in claim 1 in which the base plate and front plate are secured by snap action inter-engagement of fingers and recesses disposed on said base plate and front plate.

10. An identification card holder as claimed in claim 1 in which the base plate has a channel of a depth sufficient that a pair of said cards are held back to back in the holder, the embossed characters of the pair of cards contacting neither the front plate nor the base plate.

11. An identification card holder as claimed in claim 1 in which the mouth of the card receiving slot has chamfered edges to facilitate insertion of the identification card.

12. An identification card holder as claimed in claim 1 in which the face hole is of a size sufficient that most of the inserted identification card can be viewed through the face hole.

13. An identification card holder as claimed in claim 1 in which the identification card bears sensitive information such as name and expiry date, which sensitive information is concealed by part of the front plate.

* * * * *